United States Patent [19]

Hickman et al.

[11] 4,154,991

[45] May 15, 1979

[54] ROTARY SWITCH

[75] Inventors: Ronald J. Hickman; William R. Mayer, both of Rochester, Ill.

[73] Assignee: Stewart-Warner Corporation, Chicago, Ill.

[21] Appl. No.: 835,400

[22] Filed: Sep. 21, 1977

[51] Int. Cl.[2] ..... H01H 3/00

[52] U.S. Cl. ..... 200/17 R; 200/6 B; 200/153 K; 200/336

[58] Field of Search ..... 200/6 R, 6 B, 6 BA, 200/6 BB, 6 C, 17 R, 18, 153 LB, 155 R, 291, 67 C, 30 AA, 27 R, 11 R, 11 K, 11 EA, 336, 153 K

[56] References Cited

U.S. PATENT DOCUMENTS

| | | | |
|---|---|---|---|
| 1,266,811 | 5/1918 | Johnson | 200/30 AA |
| 2,762,876 | 9/1956 | Glogau et al. | 200/11 EA |
| 3,163,724 | 12/1964 | Roeser | 200/153 LB X |
| 3,251,956 | 5/1966 | Rasor et al. | 200/6 B X |
| 3,271,531 | 9/1966 | Winogrocki et al. | 200/6 B |
| 3,310,642 | 3/1967 | Zeller | 200/6 B X |
| 3,596,013 | 7/1971 | Pihl | 200/11 EA |
| 4,025,738 | 5/1977 | Erwin et al. | 200/6 B |

*Primary Examiner*—James R. Scott

[57] ABSTRACT

A rotary switch for high current applications that rapidly actuates a first set of contacts in one direction of rotation of the switch and actuates the first set and a second set of contacts upon rotation of the switch in the other direction. Each set of contacts has a follower roller that is moved by a rotary cam biased axially by a detent assembly that prevents rotation of the cam below a predetermined rotational force. A torsion spring assembly is provided for overcoming the detent assembly force and rapidly rotating the cam by the energy stored in the torsional spring. The torsional spring assembly has a radial projection that is engaged by a rotary operating member that also engages the ends of the torsional spring to wind the spring and store energy up to the point where the operator member engages the radial projection to rotate the entire torsional spring assembly including the contact actuating cam permitting the energy stored within the torsional spring assembly to be released to rotate the actuating cam which controls the contact members.

4 Claims, 16 Drawing Figures

15
16
19
43
46
45
54
51
52
44
38
39
29
28
41
49
42
27
48
61
57
58
25
70
65
47
66
101
69
67
100
56
11
97
104
102
96
92
64
86
98
91
90
95
85
75
94
89
79
72
82
81
73
84
83
78
77
74

ROTARY SWITCH

BACKGROUND OF THE PRESENT INVENTION

This invention relates to a rotary switch specially designed for high current applications. One such application is in what may be referred to as a "heat-start switch." This switch is designed to selectively or simultaneously actuate the glow plugs in a diesel engine and the diesel engine starter motor. In one direction of rotation of the switch, the glow plugs are actuated and in the other direction of rotation of the switch, both the glow plugs and the starter-motor are actuated so that the vehicle operator may initially warm the engine cylinders and thereafter, while turning the switch in the other direction of rotation, start the engine.

The glow plugs and the starter motor circuits both carry high current and are therefore very susceptible to arcing across the switch contacts which of course would eventually result in destruction of the contacts. It is therefore very desirable to space the contact members far apart and provide for very rapid contact closure to minimize the effects of this problem.

Another problem in heat start switches presently produced is that they are sensitive to the amount of pressure that the human operator imposes on the switch during operation. This of course is undesirable since it provides a variable set point for the switch and also may cause eventual contact damage. It is therefore desirable to provide a switch in this application which has a predetermined setpoint as a result of the switch design irrespective of the amount of effort the operator employs in actuating the switch.

It is a primary object of the present invention to overcome these problems in rotary switch applications.

SUMMARY OF THE PRESENT INVENTION

In accordance with the present invention, a rotary switch assembly is provided for high current applications in which the contact members close very rapidly and also in which the setpoint of the switch is determined by the internal construction of the switch and not by the amount of effort that the human operator employs in actuating the switch. Two sets of contacts are provided in the bottom of a switch housing, one for controlling actuation of the glow plugs in a vehicular diesel engine and the other set for controlling actuation of the starter motor for the engine. The switch is designed so that rotation of the switch in one direction will actuate the glow plugs to preheat the engine during starting and rotation of the switch in the other direction will actuate both the glow plugs and the engine's starter motor to effect engine starting.

The contact sets are actuated by a centrally mounted rotary cam having cam surfaces engageable with follower rollers carried by the contacts. This cam is held against rotary movement in its neutral position by a detent assembly against a rotational force below a given value. This detent assembly prevents actuation of the switch while a torsional spring assembly stores energy that is to be released after a predetermined energy is stored.

The torsional spring assembly stores energy that is released after the cam begins movement and also directly engages the cam to overcome the force of the detent restraining the cam. A rotary operator member engages and winds a torsional spring in the torsion spring assembly in both directions of movement to initially wind the spring during the first movement of the operator member and to thereafter directly engage the torsional spring assembly to rotate it as well as the cam to begin the actuating movement. Thereafter the torsional spring is released rapidly rotating the cam and closing one or both contacts depending upon which direction the operator member is rotated.

DETAILED DESCRIPTION OF THE PREFERRED EMBODIMENT

Figures 1, 2, 3:
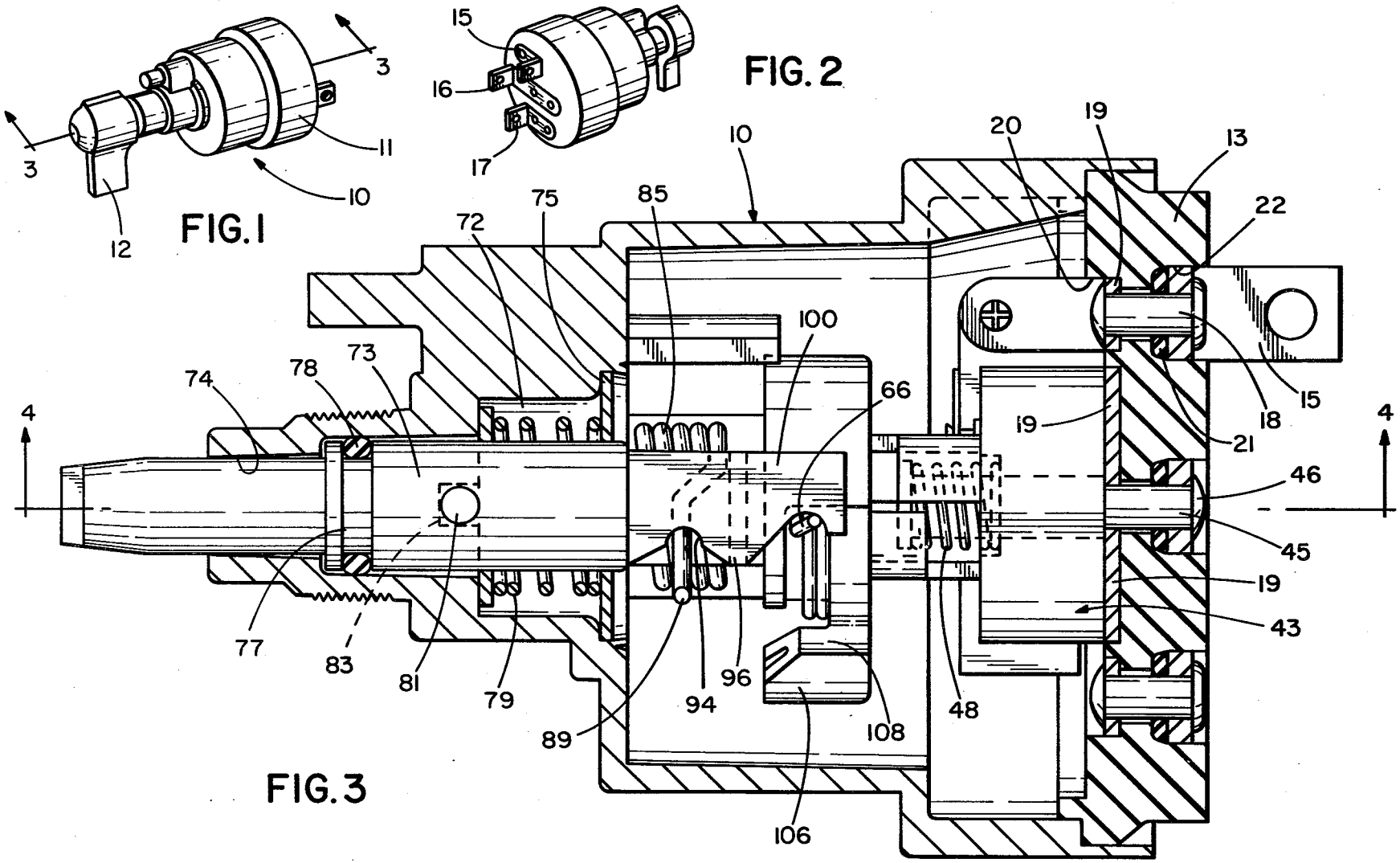
FIG. 1 is a perspective view of the present rotary switch assembly.
FIG. 2 is a rear perspective view of the rotary switch assembly.
FIG. 3 is an enlarged partly cross-sectioned view of the entire assembly.

Referring to the drawings and particularly FIGS. 1 to 4, a rotary switch assembly 10 is illustrated having a stepped cylindrical housing 11, a thumb and finger type handle member 12 and a cylindrical base plate 13.

The base plate 13 has L-shaped terminals 15, 16 and 17 fixed thereto by rivets 18 which extend through the base plate as well as through a cylindrical bearing plate 19 seated in a counterbore 20 in the top of the base plate 13. O-rings 21 are provided between the L-shaped terminals 15, 16 and 17 and receiving recesses 22 in the base plate 13. Terminal 16 is the ignition terminal while terminal 15 is the glow plug terminal and terminal 17 is the starter motor terminal. The bearing plate 19 is U-shaped in configuration and has upstanding end portions 24 and 25 that serve as supports for U-shaped spring contact arms 26 and 27 which are supported thereon by rivets 28 and 29.

Figure 9:
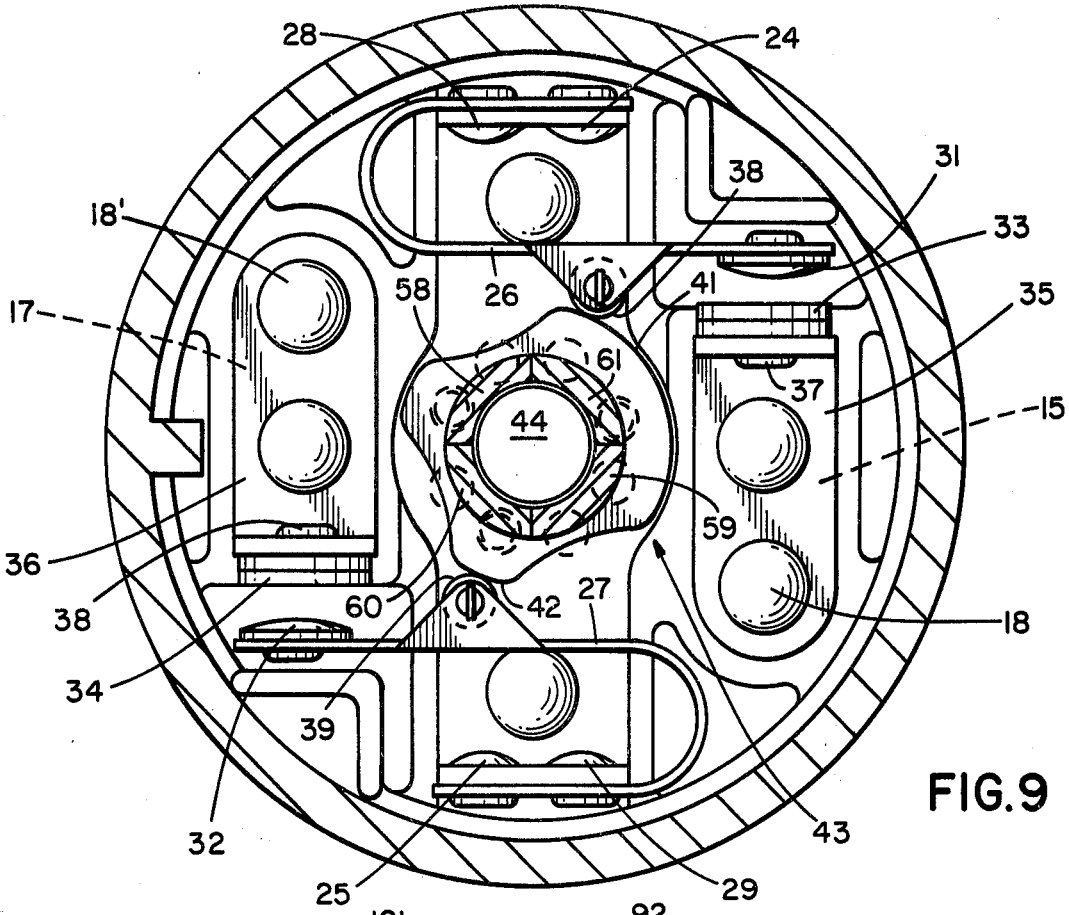
FIG. 9 is a cross-section taken generally along line 9—9 of FIG. 4.
Figure 16:
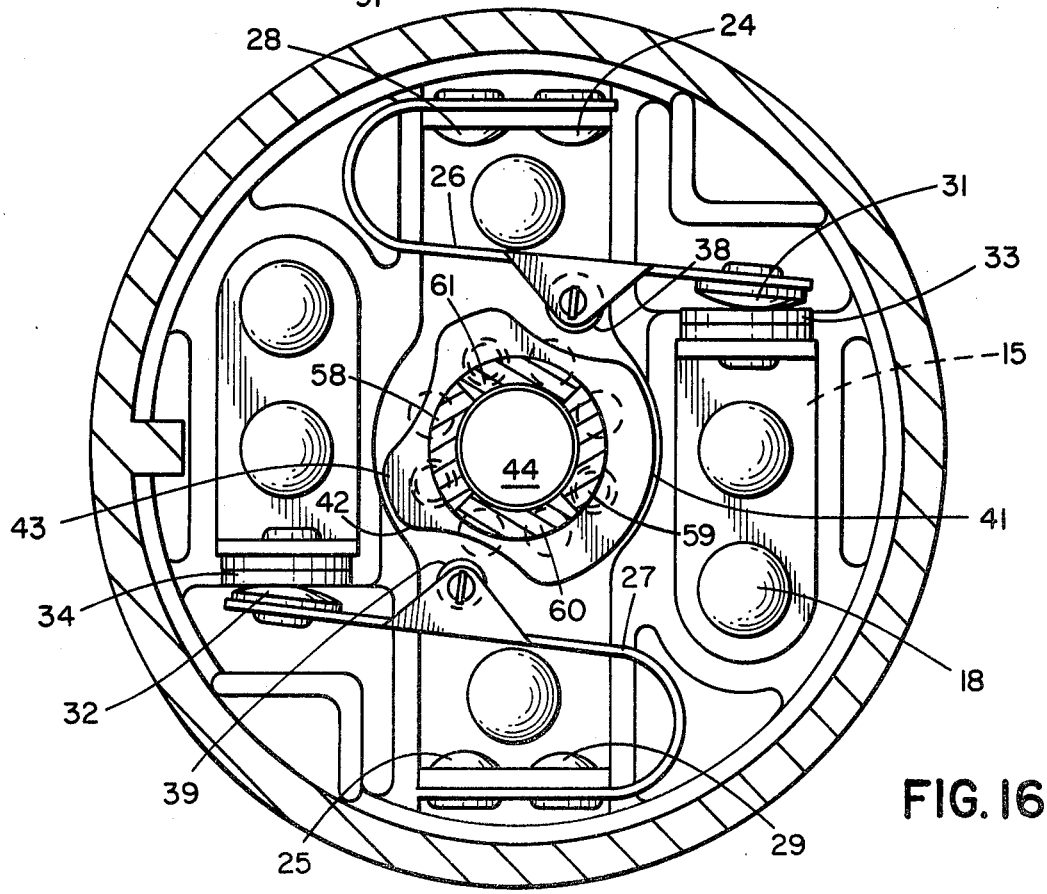
FIG. 16 is a cross-section similar to FIG. 9 with a cam assembly rotated to its clockwise actuated position.

As seen more clearly in FIG. 9, the spring contact arms 26 and 27 have contacts 31 and 32 at the distal ends thereof that are adapted to engage stationary contacts 33 and 34. The stationary contacts 33 and 34 are supported by L-shaped brackets 35 and 36 by rivets 37 and 38. Bracket 35 is electrically connected to terminal 17 by rivets 18 while bracket 36 is electrically connected to terminal 15 by rivets 18'. Thus the contacts 32,34 represent the contact set for the glow plug terminal 15 and the contacts 31,33 represent the contact set for the starter motor terminal 17. The spring arms 26 and 27 urge their contact elements 31 and 32 to the closed position shown in FIG. 16.

As seen clearly in FIG. 9, each of the spring arms 26 and 27 carries a follower roller 38 and 39 about a vertical axis with respect to the axis of the switch assembly itself.

Figure 4:
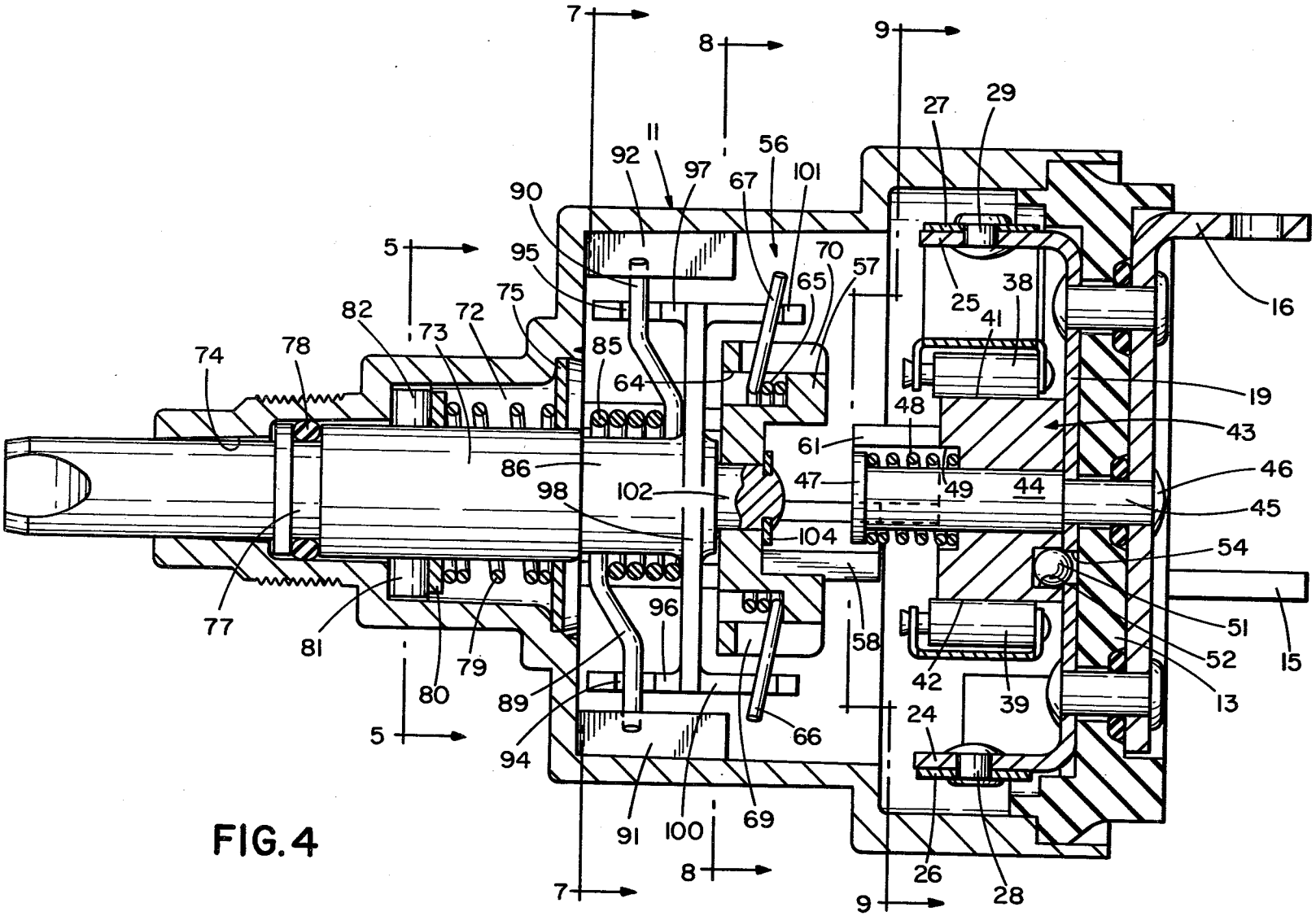
FIG. 4 is a cross-section similar to FIG. 3 with the cam and torsion spring illustrated in cross-section.
Figure 10:
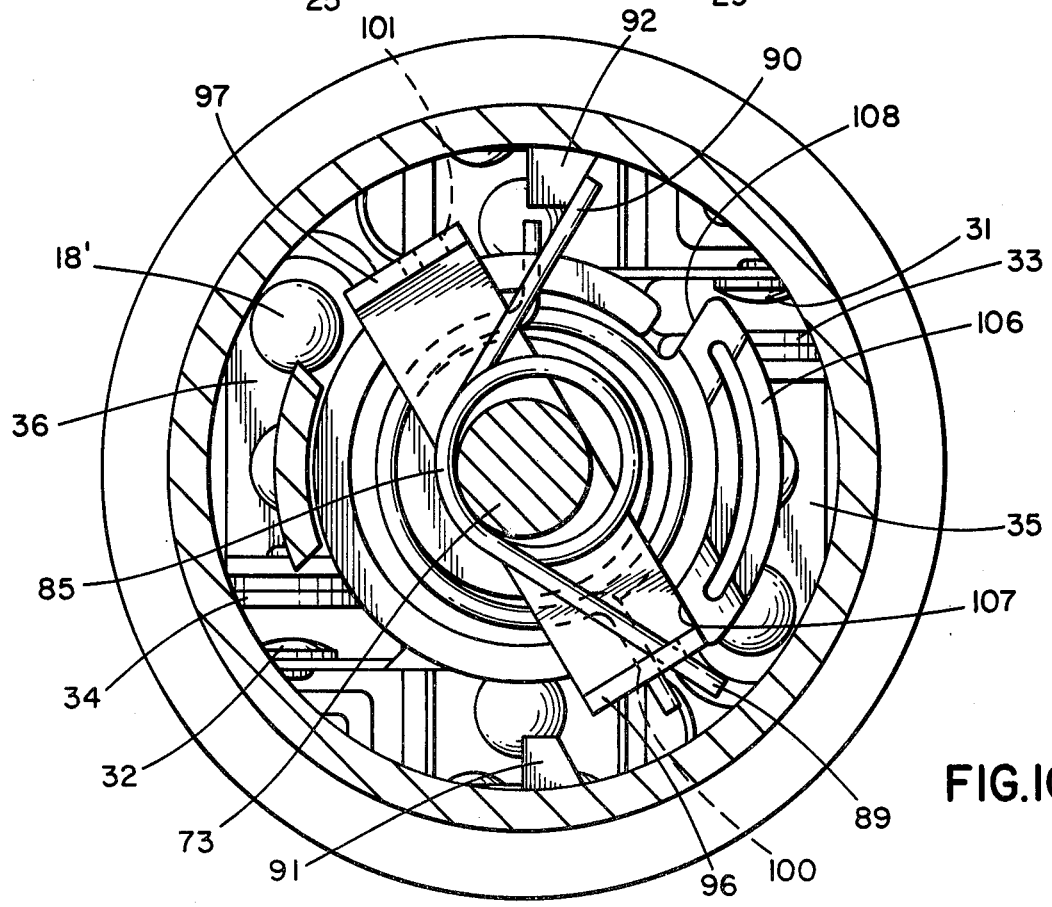
FIG. 10 is a cross-section similar to FIG. 7 with the operator member rotated to its counterclockwise "make" position.

As seen in FIGS. 4, 9 and 10, the follower rollers engage cam surfaces 41 and 42 on the periphery of a cam member 43 that is rotatably mounted on a stepped shaft 44. Shaft 44 has a reduced portion 45 extending through the base plate 13, bearing plate 19 and L-shaped terminal 16 and is held from upward movement by an integral head 46. Shaft 46 has an upper flange 47 that serves as a spring seat for a coil compression spring 48 that is received in a counter-bore 49 in the upper end of the cam 43 for biasing the cam 43 downwardly.

The spring 48 in combination with a ball detent 51 seated within an offset aperture 52 in the lower surface of cam member 43 form a detent mechanism. In the neutral position of the cam 43, the ball 51 is partly received in a bore 54 in bearing plate 19. The detent assembly exerts a predetermined downward force on the cam member 43 and also prevents rotation of the cam member 43 against a predetermined rotational force on the cam member 43 in either direction of rotation.

As may be seen more clearly in FIG. 9, the cam surfaces 41 and 42 are configured so that upon counterclockwise rotational movement, the glow plug contacts 32 and 34 will close while on clockwise rotational movement from the position shown in FIG. 9, both the glow plug contacts 32 and 34 and the starter motor contacts 31 and 33 will close.

Figure 7:
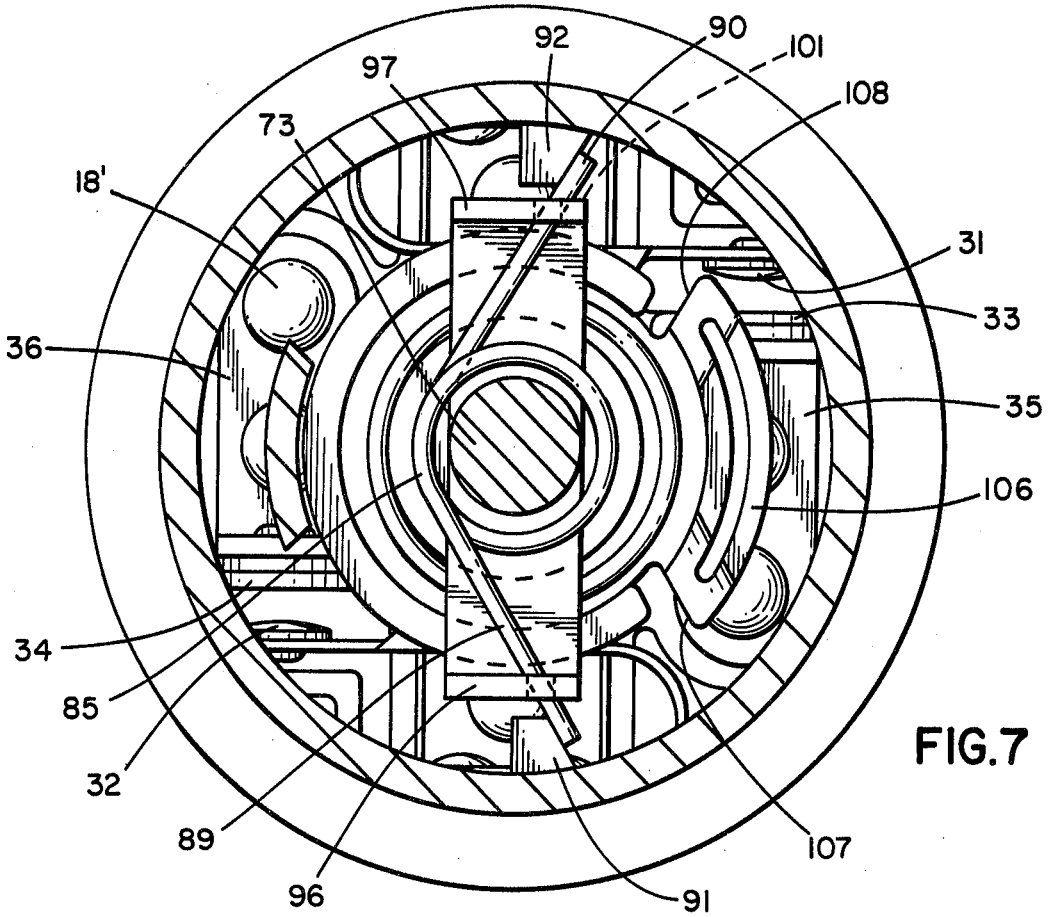
FIG. 7 is a cross-section taken generally along line 7—7 of FIG. 4.
Figure 8:
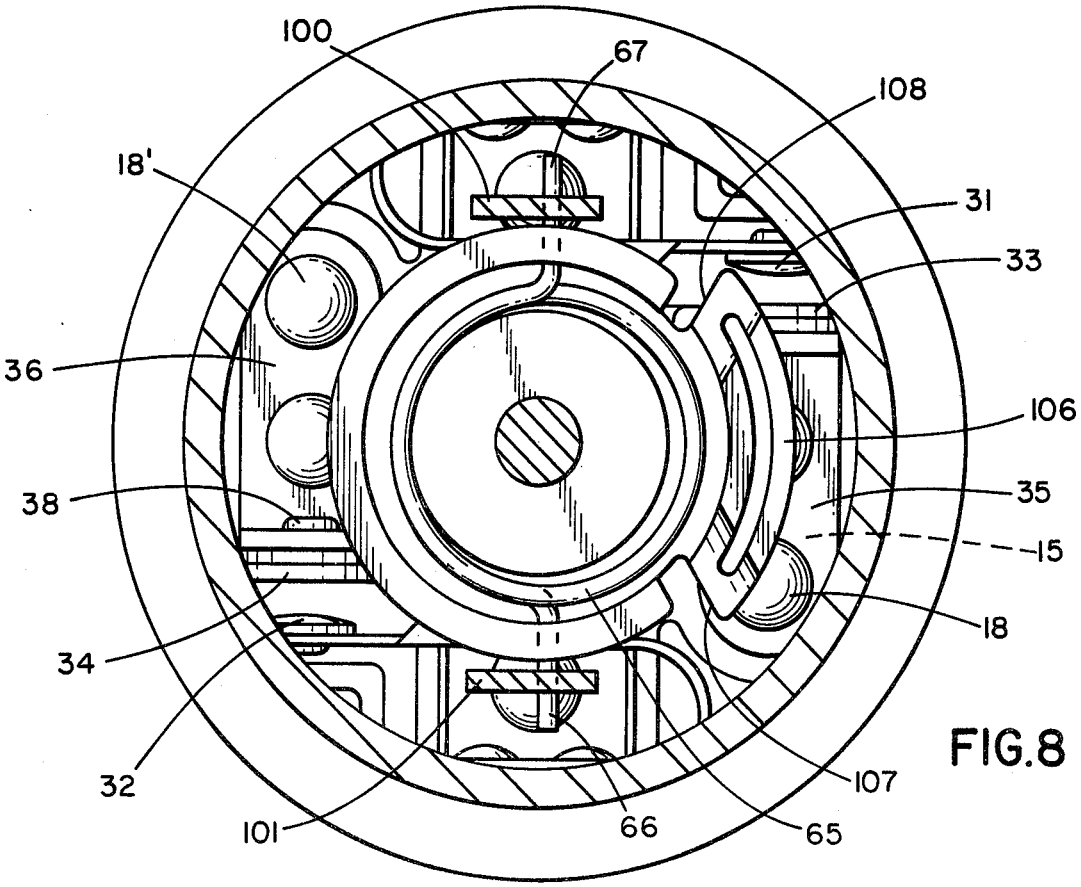
FIG. 8 is a cross-section taken generally along line 8—8 of FIG. 4.

As seen clearly in FIGS. 4, 7 and 8, a torsion spring assembly 56 is provided for storing energy to achieve rapid actuation of the cam 43. The torsion spring assembly 56 and the cam 43 together form what is sometimes referred to hereinafter as an actuating member. The coil assembly includes a generally cylindrical body 57 having two downwardly projecting arcuate sections 58 and 59 (see FIG. 9) that are axially slidable between similarly configured upwardly extending integral arcuate segments 60 and 61 from the cam 43. In this manner, the torsion spring assembly rotationally drives the cam 43 without lost motion but is permitted axially slidable motion with respect thereto.

An upwardly opening annular recess 64 is provided in the body 57 for receiving a torsion spring 65 having radially outwardly projecting ends 66 and 67 that in the neutral position of the switch, engage and are restrained by shoulders 69 and 70 on the cylindrical body 57.

An operator assembly 72 is provided for compressing torsion spring 65 to store energy within the torsion spring assembly 56 and also for mechanically rotating the coil assembly 56 after a predetermined angular movement of the operator assembly 72 in either direction. Toward this end a stepped shaft 73 is provided rotatably mounted in a reduced housing bore 74 and a spring seat plate 75. Shaft 73 has a reduced portion 77 for receiving an O-ring 78. The operator assembly 73 is biased to its upward position shown in FIG. 4 by a spring 79 reacting against spring seat 75 at one end and spring seat plate 80 at the other which engages lateral projections 81 and 82 formed integrally with shaft 73.

The projections 81 and 82 are received in corresponding recesses 83 and 84 in the housing to prevent rotation of the operator assembly 72 in its upper position.

The operator assembly 72 is biased to its neutral position shown in FIGS. 4, 7 and 8 by a torsion spring 85 surrounding shaft 73 at reduced section 86 and has outwardly extending ends 89 and 90 that engage abutments 91 and 92 formed integrally with the housing 11, as shown in FIG. 7, when the operator assembly 73 is in the neutral position. The spring ends 89 and 90 extend through openings 94 and 95 in upwardly extending flanges 96 and 97 on a laterally extending bracket 98 fixed to shaft 73.

Thus, as the shaft 73 is rotated counterclockwise from its position shown in FIG. 7 to its position shown in FIG. 10, flange 96 will carry spring arm 89 away from the abutment 91 compressing spring 85. The energy stored in the spring will of course tend to rotate the operator assembly back to its neutral position shown in FIG. 7 against the force of the operator manually rotating the shaft 73. Similarly, upon clockwise rotation of shaft 73 from its position shown in FIG. 7, flange 97 will carry spring arm 85 away from abutment 92 creating the biasing force to return the operator assembly 72 to neutral upon release of the shaft 73 by the operator.

The operator assembly 72 causes a build-up of energy in the coil assembly 56 by the engagement between downwardly projecting flanges 100 and 101 from bracket 89 engaging the spring ends 66 and 67 of the torsion spring 65 and the coil assembly 56. Thus upon clockwise rotation of the operator assembly, the spring arm 101 will move spring end 67 away from the abutment 70 while spring arm 100 moves away from spring end 66 which remains in contact with abutment 69 storing clockwise rotational energy within the torsion spring assembly 56 so long as the body 57 remains stationary. Toward this end, the body 57 is rotationally mounted upon a reduced end 102 on shaft 73 and prevented from axial movement with respect thereto by a snap ring 104.

To mechanically start movement of the actuating member including coil assembly 56 and cam 43, by the operator assembly 72, an arcuate projection 106 is formed integrally with the body 57. As seen more clearly in FIGS. 7 and 8, this projection has end surfaces 107 and 108 in rotational alignment with the downward flanges 100 and 101 on the operator assembly. In this manner and as seen in FIG. 10, after a predetermined arcuate rotational motion of the coil assembly or the operator assembly 72 from its neutral position shown in FIG. 7, the downwardly projecting arm 100 (below and in alignment with arm 97 in FIG. 10) will engage projection surface 107 causing rotation of the body 57 which drives the cam 43 through the interfitting projections 58, 59, 60 and 61 therebetween, causing switch actuation.

Figures 5, 6:
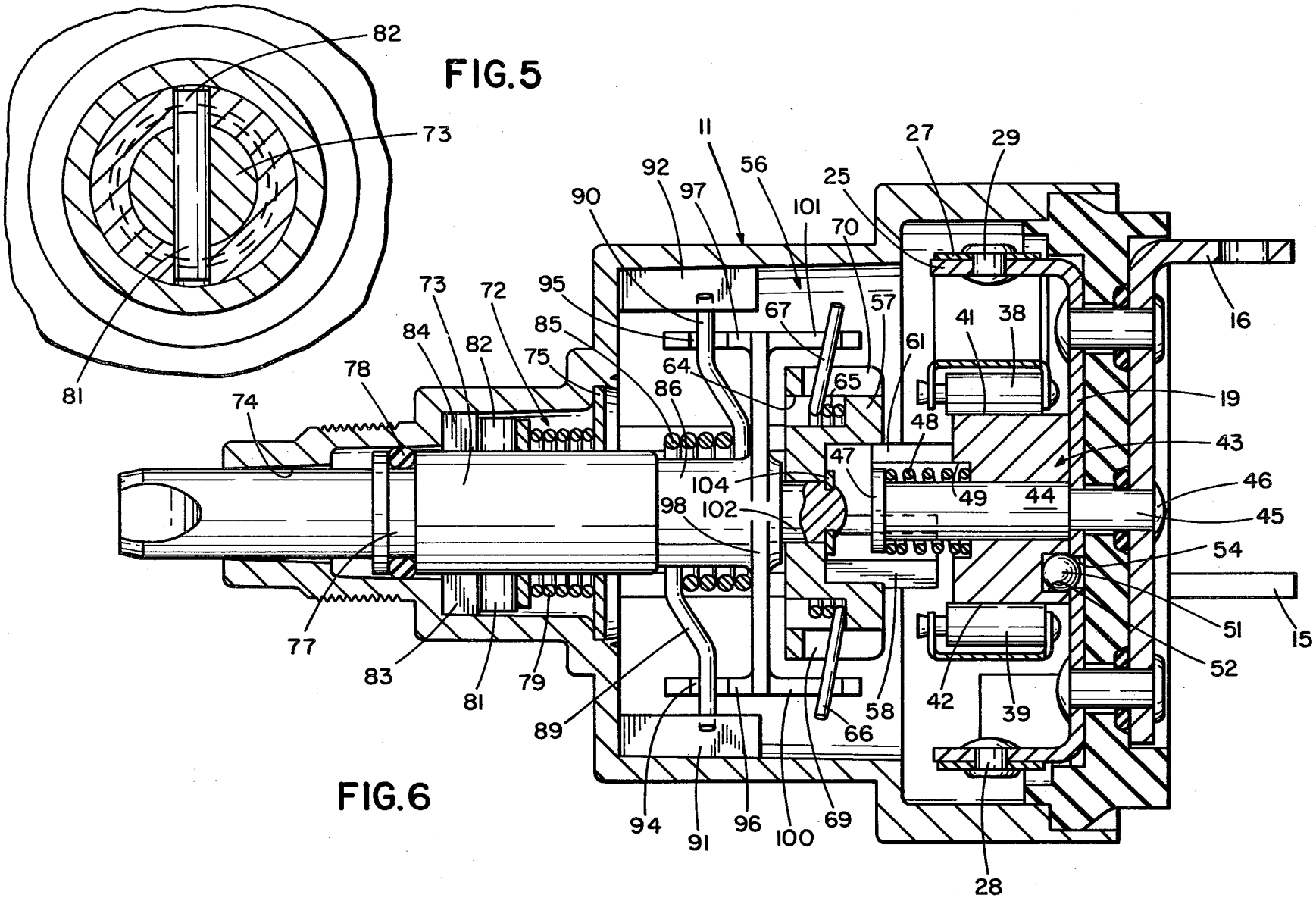
FIG. 5 is a fragmentary section taken generally along line 5—5 of FIG. 4.
FIG. 6 is a cross-section of the spring assembly with the operator member in its active position.

The operator assembly must be depressed before rotation can occur so that the operator initially depresses the switch knob 12 shown in FIG. 1 (but not illustrated in FIG. 6) downwardly to the position shown in FIG. 6 freeing projections 81 and 82 from the recesses 83 and 84 in the housing, and in this position the operator assembly 72 is free to rotate. The operator then rotates the operator assembly in a counterclockwise direction to actuate the glow plugs. As the operator assembly is rotated in a counterclockwise direction from neutral the torsion spring assembly 56 and the cam 43 will remain stationary with respect to the operator assembly. Torsion spring 65 will compress by engagement between downwardly projecting arm 100 and spring end 66 to store rotational energy within the spring. This provides an increasing counterclockwise rotational force on the torsion spring member 57 by the reaction force exerted by spring arm 67 against shoulder surface 70 on member 57. This force of course, increases as the angular rotation of the shaft 73 continues.

Figure 11:
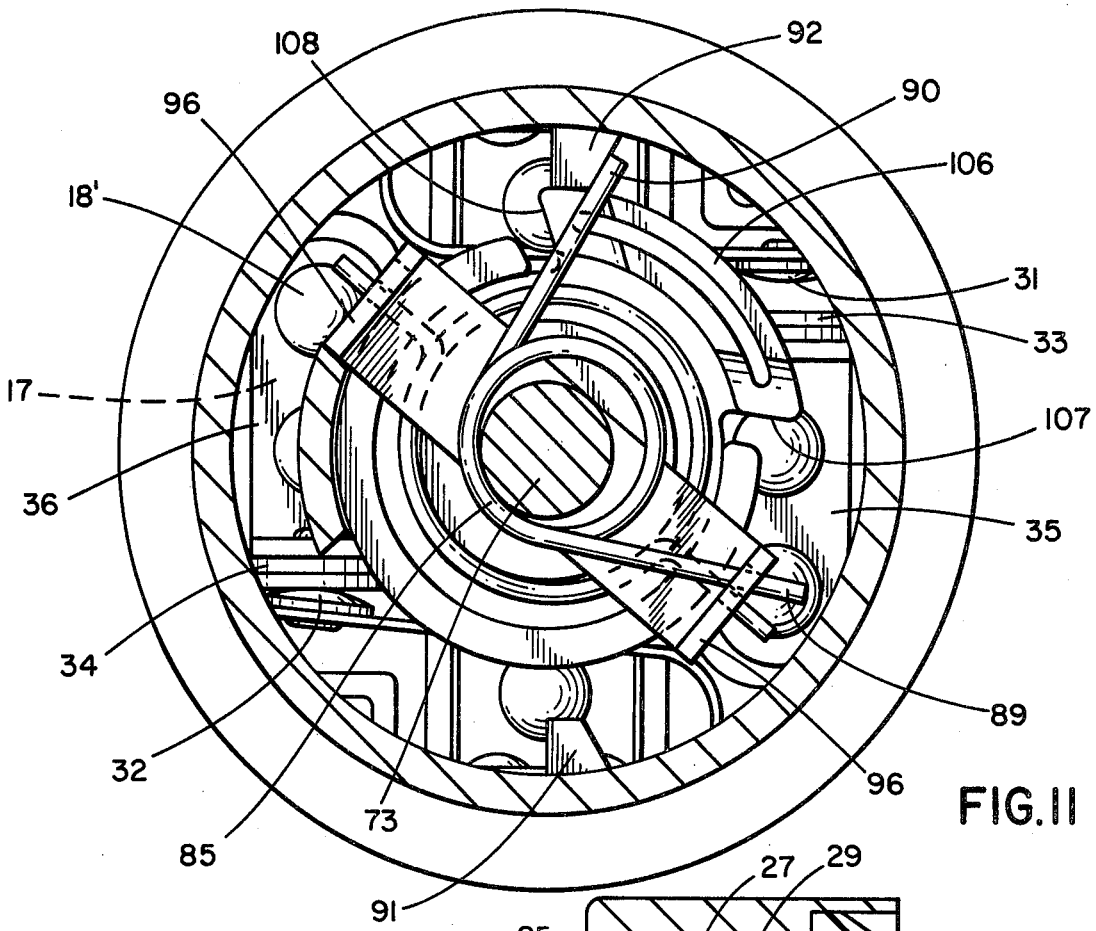
FIG. 11 is a cross-section similar to FIG. 7 with the torsion spring assembly actuated in its counterclockwise direction.
Figure 12:
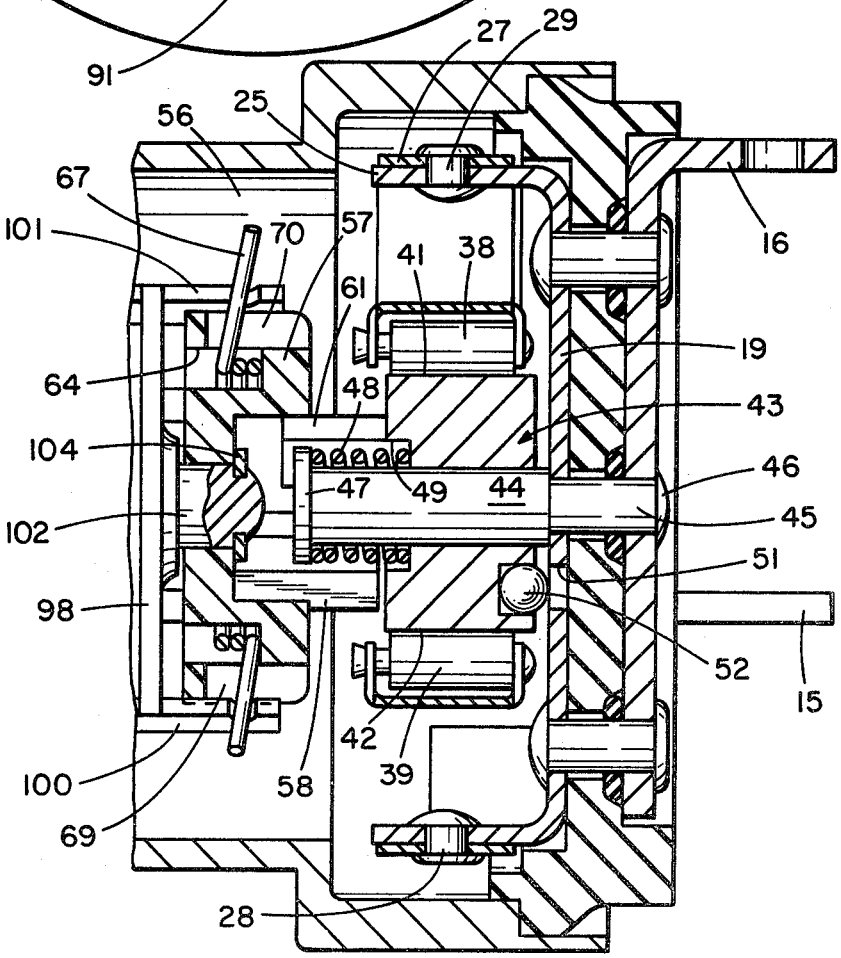
FIG. 12 is a fragmentary cross-section of the cam assembly immediately after the detent mechanism has been overcome at the "make" point.
Figure 13:
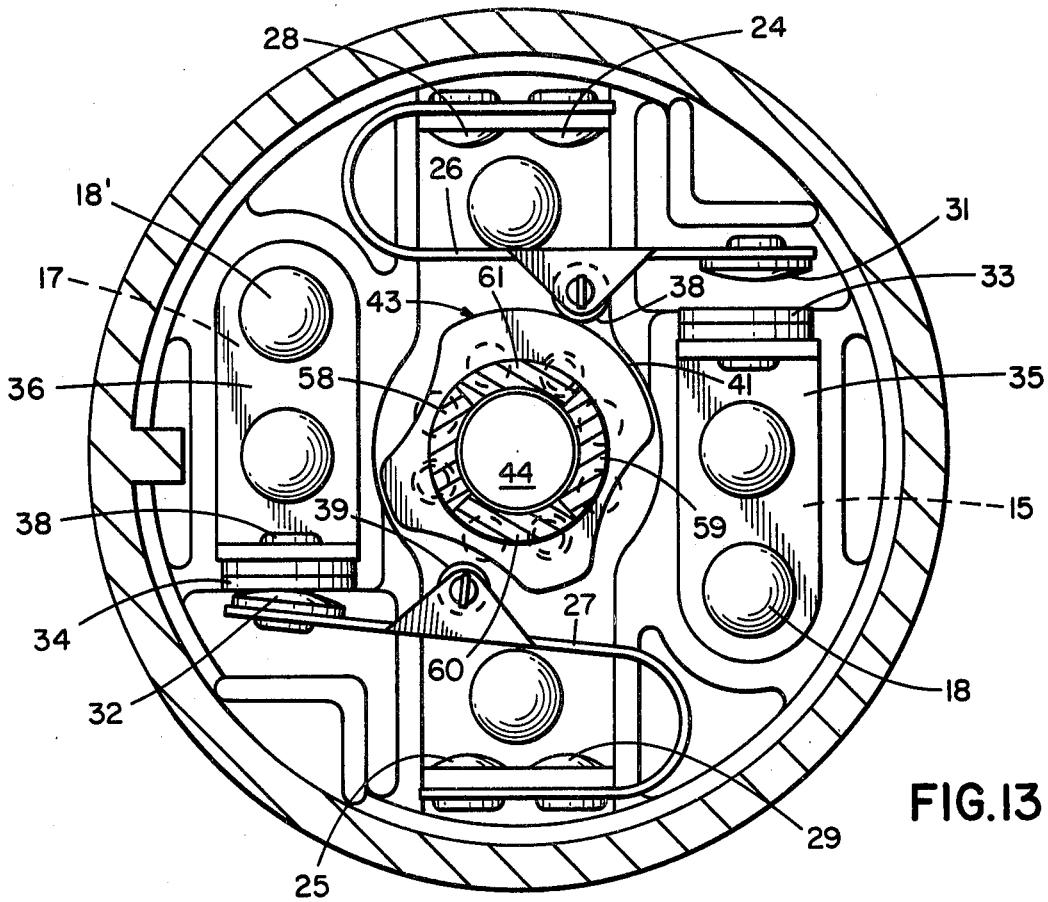
FIG. 13 is a cross-section similar to FIG. 9 with the cam assembly rotated to its clockwise actuated position.

After a predetermined angular rotation of the operator assembly 72, downwardly projecting flange 100 will engage projection surface 107 as shown in FIG. 10. Further counterclockwise rotation of the operator assembly will overcome the rotational restrained force of the detent assembly acting on cam member 43 permitting the cam member 43 to raise slightly to the position shown in FIG. 12 against the downward biasing force of spring 48 thereby permitting rotation of the torsion spring assembly 56 to the position shown in FIG. 11 and the cam 43 to the position shown in FIG. 13. After detent 51 leaves aperture 54 in the bearing plate 18, the cam 43 is free to rotate and the previously compressed torsion spring 65 and particularly arm 67 acting on surface 70, rapidly decompresses spring 65 acting on surface 70 of body 57 rapidly spins the body 57 and the cam 43 in a clockwise direction. This moves the cam 43 from its position shown in FIG. 9 to its position shown in FIG. 13, closing contacts 32,34 associated with the actuation of the glow plugs. In this manner, the contacts are rapidly closed at a predetermined point not determined by any movement of the human operator other than rotation of the operator assembly.

Upon release of the operator shaft 73 by the human operator, spring 89 will return the operator assembly to its neutral position and torsion spring 65 in the torsion spring assembly 56 will return the body member 57 and the cam 43 to the neutral position.

Figure 14:
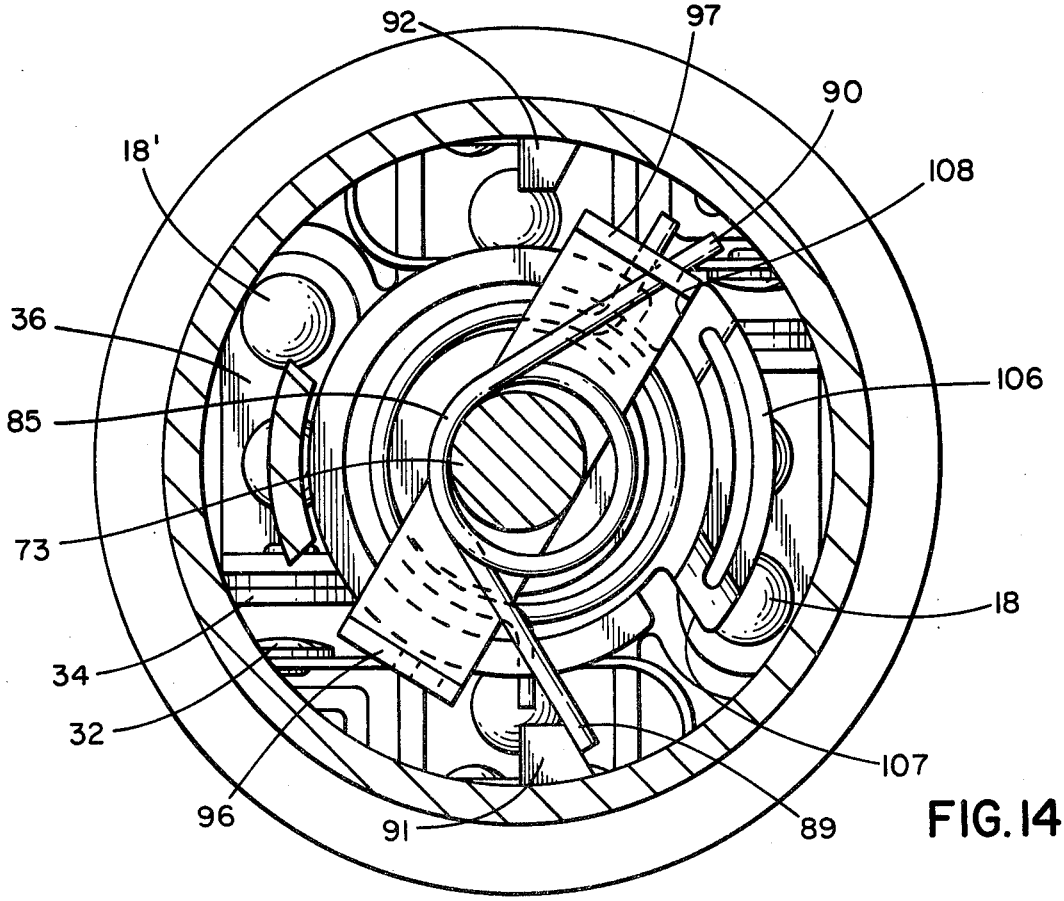
FIG. 14 is a cross-section similar to that shown in FIG. 7 with the operator rotated to its clockwise "make"position.
Figure 15:
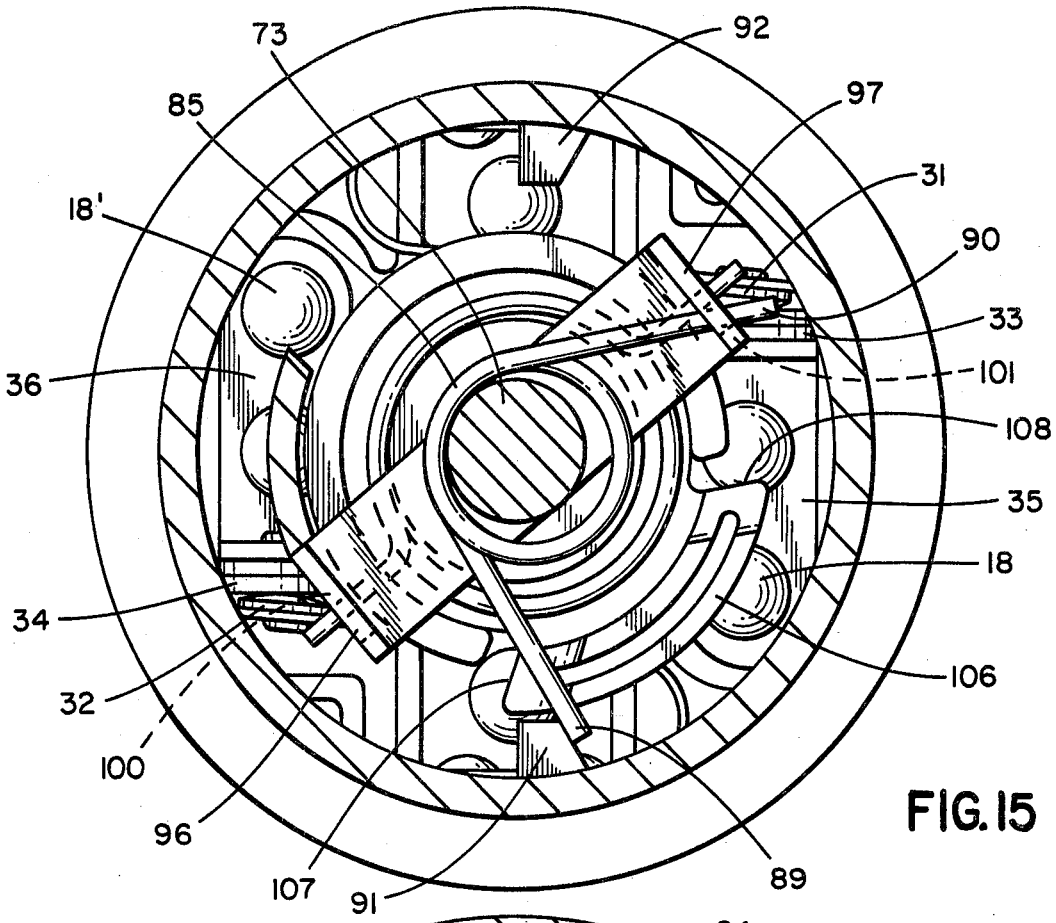
FIG. 15 is a cross-section similar to FIG. 7 with the torsion spring assembly rotated to its clockwise actuated position.

Upon clockwise rotation of shaft 73, flange 101 will rotate spring arm 67 compressing spring 65 to exert an increasing clockwise biasing force on member 57 by the action of spring end 66 engaging torsion member surface 69. After a predetermined angular rotation of the operator, flange 101 will engage projection surface 108 as seen in FIG. 14. Further clockwise rotation of the operator will cause the force of the operator assembly on the torsional spring body 57 to overcome the predetermined rotational restraining force of the detent assembly acting on cam 43 causing the cam 43 to raise sufficiently to permit the ball 51 to move out of the opening 54 in the bearing plate 19 against the biasing force of spring 48 permitting the cam 43 to freely rotate in a clockwise direction. The previously stored compression force on spring 65 is thereupon released and the force of spring end 66 acting on body surface 69 will cause rapid rotational force of the body 57 which drives the cam 43 in a clockwise direction to the position shown in FIG. 16. The body member 57 moves to the position shown in FIG. 15 and the cam 43 simultaneously moves to the position shown in FIG. 16 where both the glow plug contacts 32,34 and the starter motor contacts 31,33 are closed.

What is claimed is:

1. A rotary switch for high current applications, comprising; a housing, a first set of contact members, a second set of contact members, a rotary actuator in said housing including a rotary cam mounted between said sets of contact members and operable when moved in one direction to close both sets of contact members and operable in the other direction to close only one of said sets of contact members, a torsion spring acting on said rotary cam and biasing said rotary cam to an "off" position where both of said sets of contact members are open, said torsion spring having two radially projecting ends, detent means acting on said actuator preventing rotation of said actuator below a predetermined rotational force on said actuator in either direction of rotation, said actuator having a lateral projection, a rotary operator member mounted for rotation in said housing about the same axis as the actuator, said operator member having spaced arms engageable with the outwardly projecting ends of the spring to bias the spring and exert an increasing rotational biasing force on the actuator as the operator member is moved in either direction of rotation, said arms being engageable with said actuator projection upon predetermined angular rotation in either direction to move the actuator overcoming the resisting force of the detent means and releasing the actuator against the biasing force of the torsion spring closing one set of contact members in one direction of rotation of the operator member and closing both sets of contact members in the other direction of rotation of the operator member.

2. A rotary switch for high current applications, comprising; a housing, a first set of contact members, a second set of contact members, a rotary actuator including a rotary cam in said housing mounted between said sets of contact members and operable when moved in one direction to close both sets of contact members and operable in the other direction to close only one set of contact members, a torsion spring acting on said rotary cam and biasing said rotary cam to an "off" position where both of said contact members are open, means acting on said actuator preventing rotation of said actuator below a predetermined rotational force on said actuator in either direction of rotation, a rotary operator member mounted in said housing for rotation about the same axis as the actuator, said operator member having means engageable with the spring to bias the spring and exert an increasing rotational biasing force on the actuator as the operator member is moved in either direction of rotation, said operator being engageable with said actuator upon predetermined angular rotation in either direction to move the actuator overcoming the force of the means acting on said actuator and releasing the actuator with the biasing force of the torsion spring closing one set of contact members in one direction of rotation of the operator member and closing both sets of control members in the other direction of rotation of the operator member.

3. A rotary switch for high current applications as claimed in claim 2, wherein said two sets of contact members have roller means engageable with said cam.

4. A rotary switch for high current applications as claimed in claim 2, including a centering spring for returning the operator member to an "off" position.

* * * * *